US011523671B2

(12) United States Patent
Lee

(10) Patent No.: US 11,523,671 B2
(45) Date of Patent: Dec. 13, 2022

(54) COSMETIC LIQUID CONTAINER

(71) Applicant: Jong-bum Lee, Bucheon-si (KR)

(72) Inventor: Jong-bum Lee, Bucheon-si (KR)

( * ) Notice: Subject to any disclaimer, the term of this patent is extended or adjusted under 35 U.S.C. 154(b) by 165 days.

(21) Appl. No.: 17/255,863

(22) PCT Filed: Apr. 23, 2019

(86) PCT No.: PCT/KR2019/004878

§ 371 (c)(1),
(2) Date: Dec. 23, 2020

(87) PCT Pub. No.: WO2020/004799

PCT Pub. Date: Jan. 2, 2020

(65) Prior Publication Data

US 2021/0368962 A1 Dec. 2, 2021

(30) Foreign Application Priority Data

Jun. 28, 2018 (KR) ..... 10-2018-0074665
Apr. 19, 2019 (KR) ..... 10-2019-0046063

(51) Int. Cl.
*A45D 34/04* (2006.01)
*B65D 83/00* (2006.01)

(52) U.S. Cl.
CPC ..... *A45D 34/04* (2013.01); *B65D 83/0033* (2013.01); *B65D 83/0038* (2013.01); *A45D 2200/055* (2013.01); *A45D 2200/056* (2013.01)

(58) Field of Classification Search
CPC ..... A45D 34/04; A45D 2200/055; A45D 2200/056; B65D 83/0005; B65D 83/0033; B65D 83/0038
See application file for complete search history.

(56) References Cited

U.S. PATENT DOCUMENTS 2,471,852 A * 5/1949 Bau ..... B65D 83/0072 222/326
3,335,913 A * 8/1967 Bouet ..... B65D 83/38 222/95

(Continued)

FOREIGN PATENT DOCUMENTS

GB 2072795 * 10/1981 ..... B65D 83/0038
KR 20-0459918 4/2012

(Continued)

OTHER PUBLICATIONS

International Search Report, with English translation, for International Application No. PCT/ KR2019/004878, dated Jul. 29, 2019.

*Primary Examiner* — J C Jacyna
(74) *Attorney, Agent, or Firm* — Kile Park Reed & Houtteman PLLC

(57) ABSTRACT

The cosmetic liquid container (1) includes: a case (7) in which a cosmetic liquid is filled; a pressing plate (43) disposed at an inner bottom of the case (7) and forming a cosmetic liquid filling space (S) in which the cosmetic liquid is filled in the upper portion, and pressing the cosmetic liquid upward; elastic members (11, 40) disposed under the pressing plate (43) and pressing the pressing plate (43) toward the cosmetic liquid filling space (S); a support part (13) coupled to the lower portion of the case (7), supporting lower portions of the elastic members (11, 40), and compensating elastic force by pressing the elastic members (11, 40) toward the pressing plate (43) upon rotation; a filling pull rod (44) mounted on the lower portion of the pressing plate (43).

6 Claims, 6 Drawing Sheets

(56) References Cited

U.S. PATENT DOCUMENTS

| | | | | |
|---|---|---|---|---|
| 4,090,646 | A * | 5/1978 | Dubiel | B65D 47/20<br>222/326 |
| 4,223,808 | A | 9/1980 | Williams et al. | |

FOREIGN PATENT DOCUMENTS

| | | | | |
|---|---|---|---|---|
| KR | 10-1645421 | | 8/2016 | |
| KR | 10-2016-0112871 | | 9/2016 | |
| KR | 20-0482297 | | 1/2017 | |
| KR | 2019124572 | * | 11/2019 | B65D 83/0038 |

* cited by examiner

COSMETIC LIQUID CONTAINER

CROSS-REFERENCE TO RELATED APPLICATION(S)

This application is a national entry of International Application No. PCT/KR2019/004878, filed on Apr. 23, 2019, which claims under 35 U.S.C. § 119(a) and 365(b) priority to and benefits of Korean Patent Application Nos. 10-2018-0074665, filed on Jun. 28, 2018 and 10-2019-0046063 filed on Apr. 19, 2019 in the Korean Intellectual Property Office, the entire contents of which are incorporated herein by reference.

TECHNICAL FIELD

The present invention relates to a cosmetic liquid container, and more particularly, to a technology for improving a structure of a cosmetic liquid container so that a cosmetic liquid stored in a case is effectively pressed and discharged to the outside.

BACKGROUND ART

In general, cosmetics are products that are used in the human body for cleansing and beautifying the human body to add attractiveness, changing appearance brightly, or maintaining or promoting the health of skin and hair, and refer to those that have a mild effect on the human body.

In addition, functional cosmetics are cosmetics that help keep the hair in a certain shape, help whitening the skin, improve skin wrinkles, burn the skin finely, or help protecting the skin from ultraviolet rays.

In particular, liquid cosmetics such as body lotion, sun cream, or mist are filled into a container, are ejected into the hand in a certain amount by pressing a pump from the outside, and are applied to the hair.

Such cosmetic liquid containers have a structure in which a cosmetic liquid such as body lotion, sun cream, or mist is filled into a container and is sprayed in a certain amount by pressing a pusher.

However, in a conventional press-type cosmetic liquid application container, a cosmetic liquid is sprayed in such a manner that a bag filled with the cosmetic liquid is pressed by pressing a pusher. Thus, the spraying amount of the cosmetic liquid decreases as the pressure to press the cosmetic liquid decreases.

DISCLOSURE

Technical Problem

Therefore, the present invention has been made in an effort to solve the above problems, and an object of the present invention is to provide a technology capable of effectively discharging a cosmetic liquid by maintaining a constant discharge pressure, even when the cosmetic liquid is consumed, by pressing the cosmetic liquid in two stages by a spring.

In addition, an object of the present invention is to provide a technology capable of easily performing a cosmetic liquid filling operation. Specifically, when the cosmetic liquid is filled into a cosmetic liquid container, a pressing plate is raised due to elasticity of a spring. A space for filling the cosmetic liquid is not sufficiently secured. Therefore, the spring is contracted to secure enough space to fill the cosmetic liquid.

Technical Solution

The present invention has been made in an effort to solve the above problems, a cosmetic liquid container (1) according to an embodiment of the present invention includes: a case (7) in which a cosmetic liquid is filled; a pressing plate (43) disposed at an inner bottom of the case (7) and forming a cosmetic liquid filling space (S) in which the cosmetic liquid is filled in the upper portion, and pressing the cosmetic liquid upward; elastic members (11, 40) disposed under the pressing plate (43) and pressing the pressing plate (43) toward the cosmetic liquid filling space (S); a support part (13) coupled to the lower portion of the case (7), supporting lower portions of the elastic members (11, 40), and compensating elastic force by pressing the elastic members (11, 40) toward the pressing plate (43) upon rotation; a filling pull rod (44) mounted on the lower portion of the pressing plate (43) and expanding the cosmetic liquid filling space (S) formed at an upper portion of the pressing plate (43) by pulling the pressing plate (43) downward to contract the elastic members (11, 40); and a pump (3) disposed to be movable upward or downward inside an upper cap (15) coupled to the upper portion of the case (7), and discharging the cosmetic liquid inside the case (7) when moving downward.

Advantageous Effects

As described above, the cosmetic liquid container according to the present invention has the following effects.

First, the bag for filling the cosmetic liquid is omitted, the cosmetic liquid is directly filled into the case, and the cosmetic liquid is pressed by the pressing plate that is pressed by the two-stage spring, so that the discharge pressure is kept constant even when the cosmetic liquid is consumed, thereby effectively discharging the cosmetic liquid.

Second, as the cosmetic liquid container is continuously used, the elastic forces of the first and second springs that are disposed at the inner lower portion of the case and elastically support the pressing plate for pressing the cosmetic liquid are lowered. By rotating the second lower cap that is rotatably mounted on the lower part of the case and supports the second spring, the first and second springs may be raised by a certain distance to adjust and compensate the decreased elastic force.

Third, when the cosmetic liquid is filled into the cosmetic liquid container, the pressing plate is raised due to the elasticity of the spring. Thus, the space for filling the cosmetic liquid is not sufficiently secured. The filling pull rod is mounted on the bottom of the pressing plate, and the spring is contracted by pulling the filling pull rod down. Therefore, the space for filling the cosmetic liquid may be sufficiently secured, so that the cosmetic liquid filling operation may be easily performed.

Fourth, when the cosmetic liquid is discharged, the suction force acts on the pressing plate that presses the cosmetic liquid at the upper side and is pulled upward. Therefore, the first and second springs supporting the pressing plate are coupled to the first and second lower caps so as not to be separated. In this manner, the cosmetic liquid may be easily discharged.

BEST MODE

Hereinafter, a gas filling-type cosmetic liquid container according to an embodiment of the present invention will be described in detail with reference to the accompanying drawings.

Figure 1:
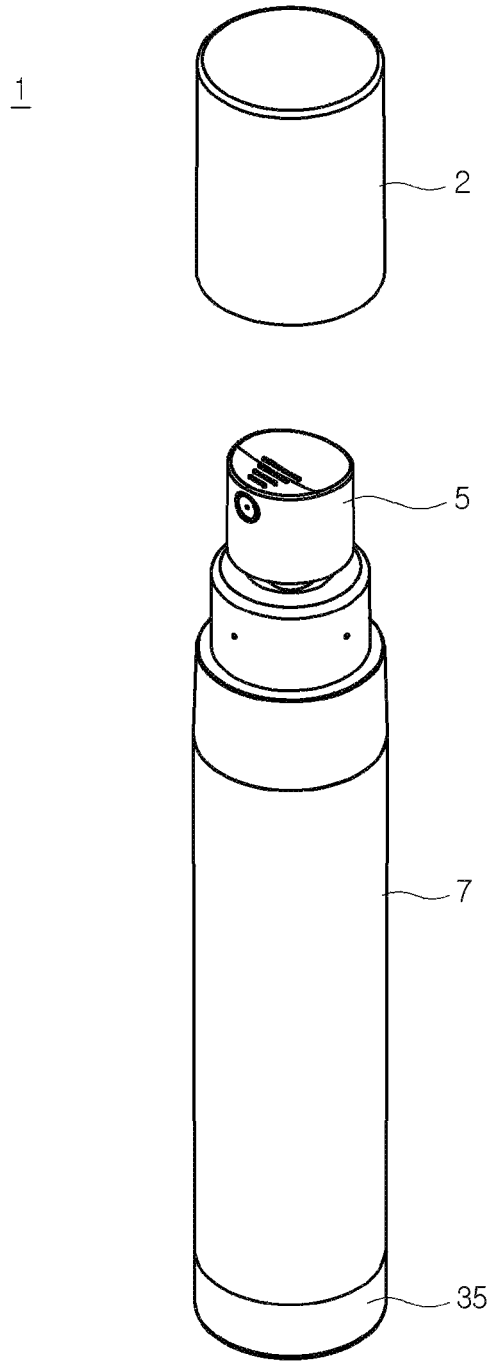
FIG. 1 is a perspective view illustrating an appearance of a filling-type cosmetic liquid container according to an embodiment of the present invention.
Figure 2:
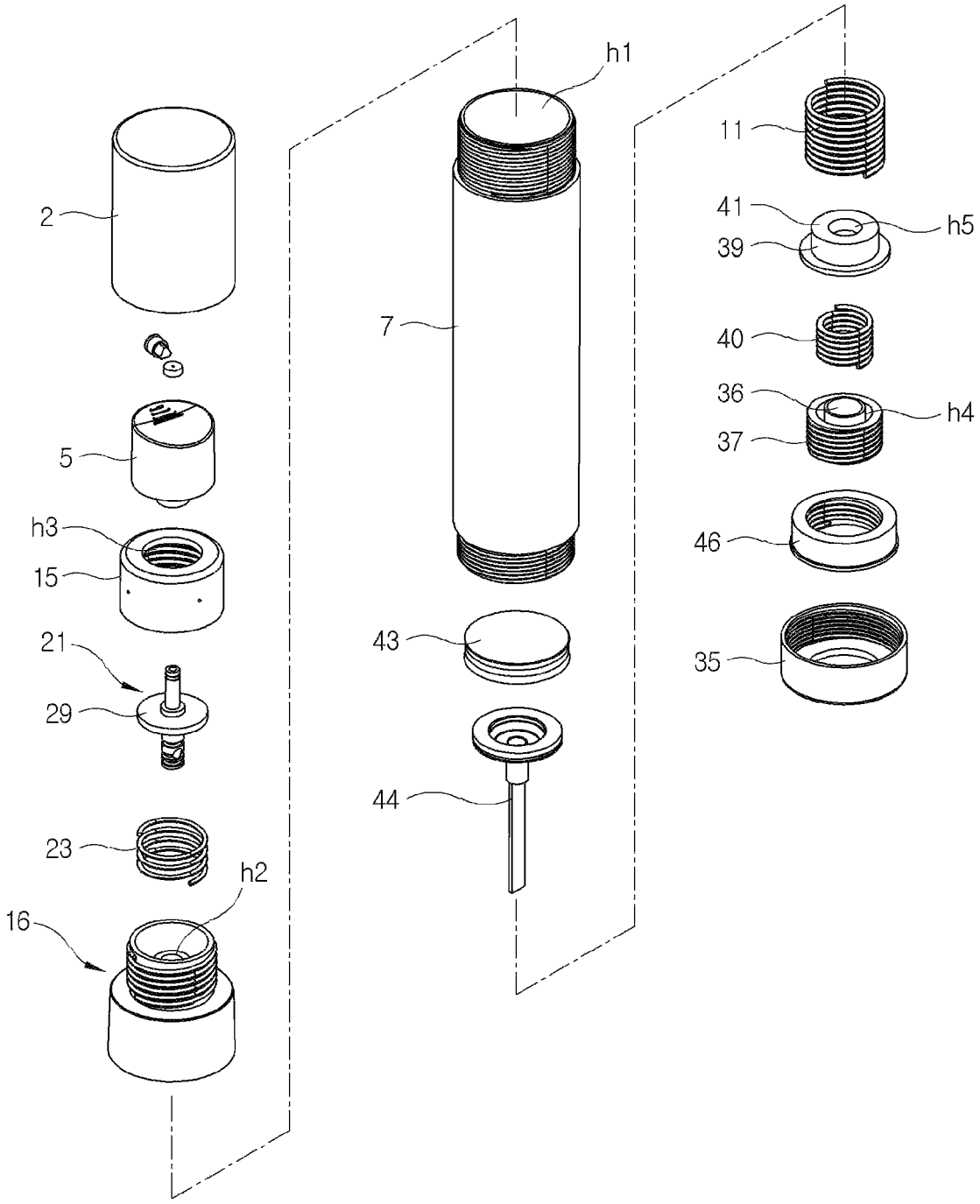
FIG. 2 is an exploded perspective view illustrating the internal structure of the cosmetic liquid container of FIG. 1.
Figure 3:
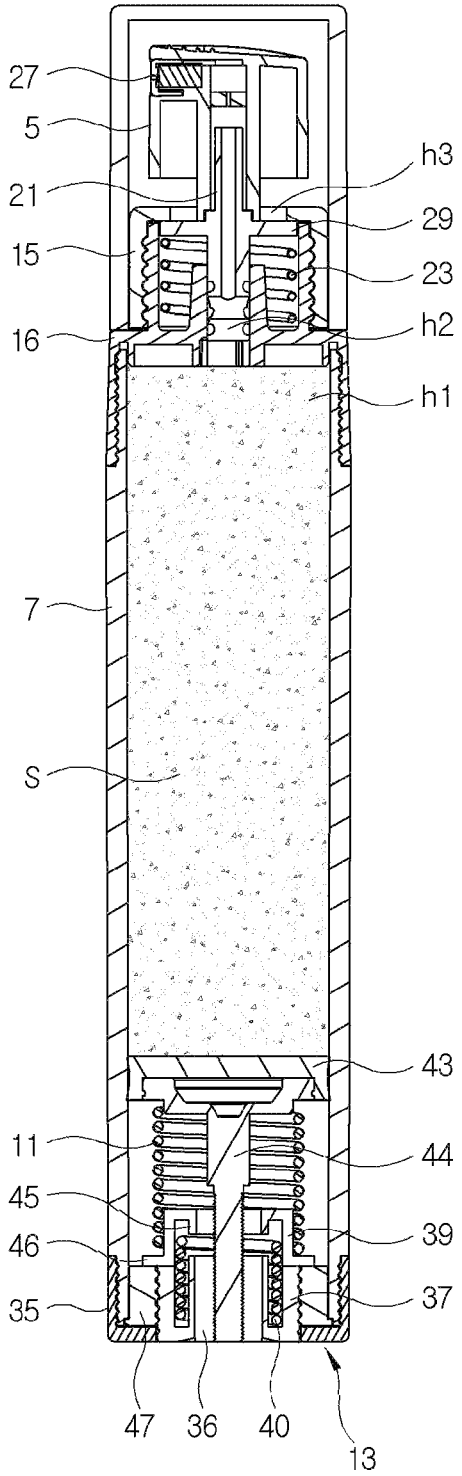
FIG. 3 is a side view illustrating the internal structure of the cosmetic liquid container of FIG. 1.
Figure 4:
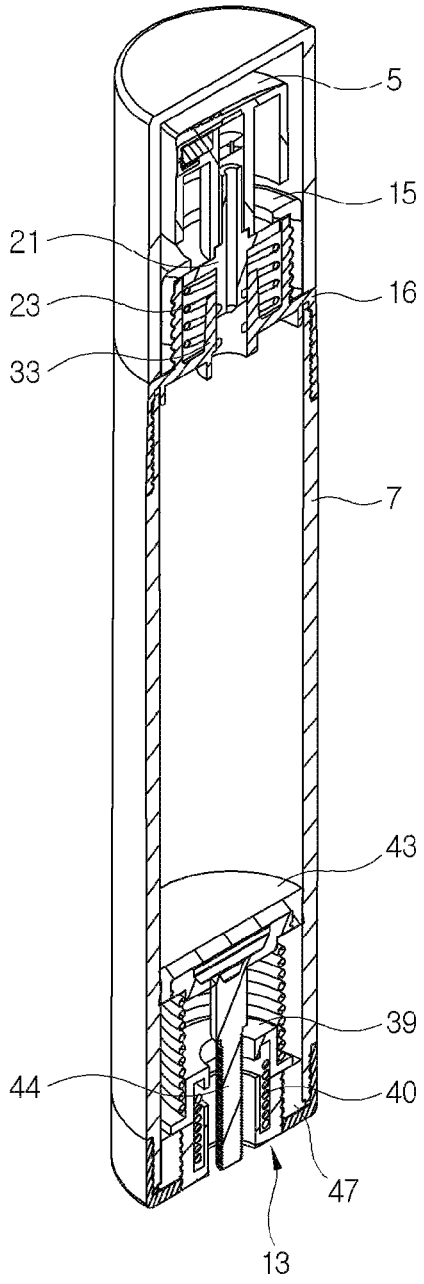
FIG. 4 is a cut-away perspective view illustrating the internal structure of the cosmetic liquid container of FIG. 1.
Figure 5:
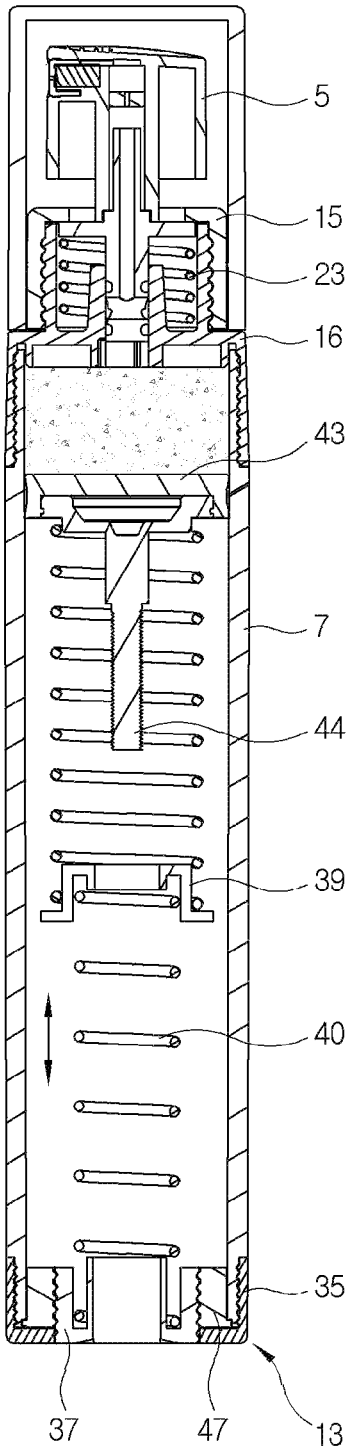
FIG. 5 is an operational state diagram of the cosmetic liquid container of FIG. 1 and is a diagram illustrating a state in which a two-stage spring disposed at a lower portion is raised as a cosmetic liquid is consumed.
Figure 6:
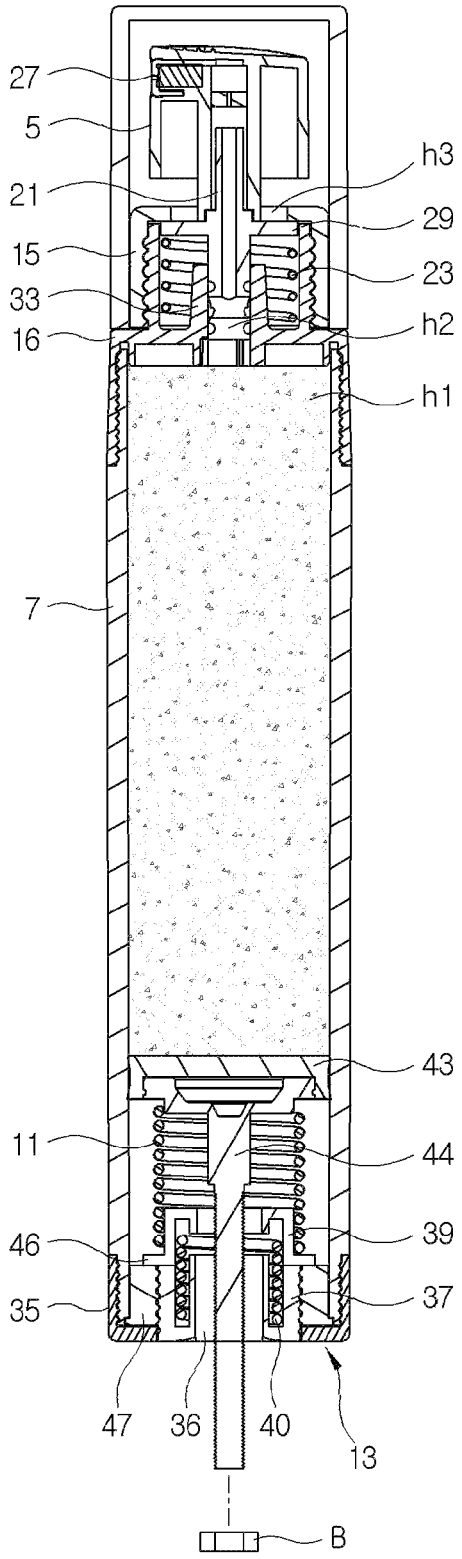
FIG. 6 is a diagram illustrating a state in which a filling pull rod of a pressing plate of FIG. 3 is pulled down and fixed by a nut.

As illustrated in FIGS. 1 to 6, a cosmetic liquid container 1 proposed in the present invention is a filling-type cosmetic liquid container that may be used by pressing a pusher 5 of a pump 3 to discharge a certain amount of a cosmetic liquid.

In this case, the cosmetic liquid may include various liquids, for example, sun cream, mist, body lotion, and the like.

The gas filling-type cosmetic liquid container 1 includes: a case 7 in which the cosmetic liquid is filled; a pressing plate 43 disposed at the inner bottom of the case 7, forming a cosmetic liquid filling space at the upper portion of the case 7, and pressing the cosmetic liquid upward; elastic members 11 and 40 disposed under the pressing plate 43 and pressing the pressing plate 43 into the cosmetic liquid filling space; a support part 13 coupled to the lower portion of the case 7, supporting the lower portions of the elastic members 11 and 40, and compensating elastic force by pressing the elastic members 11 and 40 toward the pressing plate 43 upon rotation; a filling pull rod 44 mounted on the lower portion of the pressing plate 43 and expanding the cosmetic liquid filling space formed at the upper portion of the pressing plate 43 by pulling the pressing plate 43 downward to contract the elastic members 11 and 40; and a pump 3 disposed to be movable upward or downward inside an upper cap 15 coupled to the upper portion of the case 7, and discharging the cosmetic liquid inside the case 7 when moving downward.

The cosmetic liquid container will be described in more detail. The case 7 has a cylindrical shape and is filled with the cosmetic liquid.

The upper portion of the case 7 is coupled to a discharge port 19 of the pump 3.

Therefore, when the pump 3 is pressed, the inside of the case 7 may be pressed to discharge the filled cosmetic liquid to the outside through the discharge port 19. In this case, since the cosmetic liquid is mixed with air in the discharging process, the cosmetic liquid may be discharged in a bubble state.

An opening hole h1 is formed at the upper portion of the case 7, and a fixing cap 16 is screwed at the upper portion of the opening hole h1. Therefore, the upper cap 15 may be coupled to the case 7 by the fixing cap 16.

This fixing cap 16 has a cylindrical neck part 31 formed therein in a circumferential direction.

An elastic body 23, which will be described later, is disposed at the outside of the neck part 33 in a vertical direction and elastically supports a piston 21 upward.

In this case, a screw thread is formed on the upper outer circumferential surface of the fixing cap 16, so that the upper cap 15 may be screwed thereto.

The piston 21 of the pump 3 passes through a through hole h2 formed inside the neck part 33 and is movable upward or downward.

The pump 3 includes: a piston 21 that is mounted inside the upper cap 15, is movable upward or downward, and has a hollow formed therein so that the cosmetic liquid extruded from the case 7 is supplied; an elastic body 23 that elastically presses the piston 21 upward; and a pusher 5 that is coupled to the upper portion of the piston 21 and has a hollow formed therein to communicate with the hollow of the piston 21 so that the cosmetic liquid is supplied.

In the pump 3 having such a structure, a protrusion 25 is formed at the upper portion of the piston 21, and the protrusion 25 protrudes upward through a hole h3 formed in the middle of the upper cap 15 and is coupled to a groove 27 formed at the lower portion of the pusher 5.

In addition, a flange 29 is formed in the middle of the piston 21, and the elastic body 23 is disposed in a space between the flange 29 and the upper surface of the case 7.

That is, the upper portion of the elastic body 23 is in contact with the bottom surface of the flange 29, and the lower portion of the elastic body 23 is in contact with the bottom of the neck part 33 protruding from the upper portion of the case 7.

In this case, the elastic body 23 includes a compression spring having elasticity in an upper direction. Of course, the elastic body 23 may include, in addition to the spring, rubber, synthetic resin, etc. having elasticity.

Therefore, the elastic body 23 presses the flange 29 upward so that the piston 21 is raised.

In contrast, when the pusher 5 is pressed, the pusher 5 presses the protrusion 25 to lower the piston 21. At this time, the elastic body 23 contracts.

In addition, when the piston 21 is raised, the upper portion of the flange 29 of the piston 21 comes into contact with the inner upper surface of the upper cap 15.

Meanwhile, the pressing plate 43 for pressing the cosmetic liquid upward, the support part 13, the filling pull rod 44, and the elastic members 11 and 40 are provided in the inner bottom of the case 7.

That is, the pressing plate 43 has a circular plate shape and has a structure that is closely inserted into the inside of the case and is movable upward or downward. When necessary, a sealing material such as packing may be attached to the circumferential surface of the pressing plate 43. A space S in which the cosmetic liquid is filled may be formed above the pressing plate 43.

When the cosmetic liquid is discharged, the storage amount of the cosmetic liquid decreases, and the pressing plate 43 is raised as much as the reduced storage amount of the cosmetic liquid by the elastic members 11 and 40 mounted on the lower portion of the pressing plate 43. Thus, the cosmetic liquid may be continuously pressed upward.

The elastic members 11 and 40 include: the first spring 11 provided under the pressing plate 43; the first lower cap 39 supporting the first spring 11 from below; and the second spring 40 provided under the first lower cap 39 and elastically supporting the first lower cap 39 upward.

In this case, the first and second springs 11 and 40 include compression springs having elasticity in the upward direction. Of course, the first and second springs 11 and 40 may include, in addition to the spring, rubber, synthetic resin, etc. having elasticity.

The upper portion of the first spring 11 is fixed to the lower portion of the pressing plate 43 so that the pressing plate 43 is elastically supported in the upper direction.

In addition, the first lower cap 39 is disposed under the first spring 11 to move upward or downward together.

That is, the first lower cap 39 has a hollow h5 formed in the vertical direction and a seating jaw 41 protruding upward in the middle of the first lower cap 39. The lower portion of the first spring 11 is elastically inserted into the seating jaw 41. Therefore, the first lower cap 39 and the first spring 11 are raised or lowered together.

When the pump 3 is pressed, suction force acts in the space S filled with the cosmetic liquid, and the pressing plate 43 is pulled upward. In this process, the pressing plate 43, the first spring 11, and the first lower cap 39 may be separated. The upper portion of the first spring 11 is fixed to the bottom of the pressing plate 43 and the lower portion of the first spring 11 is fixed to the first lower cap 39, thereby preventing separation. Of course, the pressing plate 43 may also be supported by the elastic force of the spring without being fixed.

The lower portion of the second spring 40 is in contact with the inner bottom of the second lower cap 37 to be described later, and the upper portion of the second spring 40 is inserted into a protrusion jaw 45 protruding from the bottom surface of the first lower cap 39, so that the second spring 40 is elastically supported.

Therefore, the second spring 40 presses the first lower cap 39 upward to raise the first lower cap 39, the first spring 11, and the pressing plate 43. Thus, the inside of the case 7 is pressed and the cosmetic liquid is pressed upward.

The elastic members 11 and 40 are provided with the first spring 11 and the second spring 40 to further increase the elastic force. Therefore the cosmetic liquid stored in the case 7 may be discharged with a stronger pressure.

At this time, when a user presses the pusher 5 to discharge a certain amount of the cosmetic liquid, the filling pressure of the case 7 decreases as much as the discharged amount. When the pressing plate 43 is raised by the elastic members 11 and 40, the filling pressure decreased by the pressing is compensated.

The support part 13 includes: a support cap 35 screwed to the lower portion of the case 7; a second lower cap 37 screwed to the inner side of the support cap 35; and a third lower cap 47 mounted between the inner side of the support cap 35 and the outer circumferential surface of the second lower cap 37.

In the support part 13, the support cap 35 is screwed to the lower portion of the case 7. A hole h4 is formed in the middle of the support cap 35, and the second lower cap 37 is screwed to the inside of the hole h4.

A jaw 36 protrudes upward on the inside of the second lower cap 37. The lower portion of the second spring 40 is inserted into the jaw 36 and is elastically supported.

Therefore, the lower portion of the second spring 40 is elastically compressed and supported on the outer circumferential surface of the jaw 36, and the upper portion of the second spring 40 is elastically supported to the protrusion jaw 45 on the bottom of the first lower cap 39, thereby performing upward pressing.

At this time, the second lower cap 37 is screwed to the support cap 35, and a screw groove is formed in the bottom surface.

Therefore, when the screw groove 38 is rotated using a tool in the outside, the second lower cap 37 may be rotated and raised by a certain distance, and thus, the first and second springs 11 and 40 may be raised.

That is, as the cosmetic liquid container 1 is used, the elastic force of the spring decreases. Thus, by rotating the second lower cap 37, the first and the first springs 11 and 40 are raised to compensate the decreased elastic force.

The filling pull rod 44 is mounted on the lower portion of the pressing plate 43. The upper portion of the filling pull rod 44 may be coupled to the lower surface of the pressing plate 43, and a thread may be formed at the lower portion of the filling pull rod 44 and may be coupled to a nut B.

The filling pull rod 44 may be applied to expand the filling space S by lowering the pressing plate 43 when the cosmetic liquid is initially filled.

That is, when the cosmetic liquid is filled into the cosmetic liquid container, the pressing plate 43 is raised due to the elasticity of the first and second springs 11 and 40 at the early stage, and thus, the upper space S of the pressing plate 43, that is, the space S for filling the cosmetic liquid, is not sufficiently secured.

Therefore, the filling pull rod 44 is initially mounted on the lower portion of the pressing plate 43, and the filling pull rod 44 is pulled down to fasten the nut B. The nut B is in contact with the bottom surface of the second lower cap 37, thereby fixing the filling pull rod 44.

As such, by fixing the filling pull rod 44 in a lowered state, the first and second springs 11 and 40 are contracted downward. Due to this, by pulling down the pressing plate 43 as well, the upper space S of the pressing plate 43, that is, the space in which the cosmetic liquid is filled, may be sufficiently expanded. Therefore, the cosmetic liquid filling operation may be easily performed.

After the cosmetic liquid is fully filled, the nut B is separated by cutting the lower end of the filling pull rod 44. Therefore, since the lower end of the filling pull rod 44 is in an unrestrained state, the filling pull rod 44 is raised together when the pressing plate 43 is raised as the cosmetic liquid is used.

A position at which the lower end of the filling pull rod 44 is cut, that is, the hole of the second lower cap 37, is sealed by a separate cap. Of course, even when not sealed, the cosmetic liquid is sealed by the pressing plate 43 when the filling pull rod 44 is raised. Thus, the cosmetic liquid does not flow out.

Hereinafter, the operation process of the gas filling-type cosmetic liquid container according to an embodiment of the present invention will be described in more detail.

As illustrated, when the pusher 5 is pressed, the pusher 5 presses the protrusion 25 to lower the piston 21.

As the piston 21 is lowered, the cosmetic liquid filled by being suctioned into the upper cap 15 in the stroke may be discharged to the outside through the discharge port 19 of the pump 3. When the force pressing the pusher 5 is released, the piston 21 is raised due to the elastic force of the elastic body 23. At this time, since the pressure difference occurs, the cosmetic liquid inside the case 7 is suctioned and raised into the internal space of the upper cap 15. Due to the pressing of the pusher 5, the cosmetic liquid may be discharged to the outside through the discharge port 19 of the pump 3.

As such, when a certain amount of the cosmetic liquid is discharged, the filling pressure of the case 7 decreases as much as the discharged amount of the cosmetic liquid.

When the filling pressure decreases, the volume of the cosmetic liquid filled in the case 7 also decreases. At this time, the pressing plate 43 under the case 7 is in a pressed state. In addition, the pressing plate 43 is in a state of being elastically supported by the first and second springs 11 and 40.

Therefore, the pressing plate 43 is pressed and raised as much as the decreased volume of the case 7 by the elastic force of the first and second springs 11 and 40, and the internal pressure of the case 7 may be maintained at a normal level.

When the pump 3 is pressed, the suction force acts in the space S filled with the cosmetic liquid. Thus, the pressing plate 43 is pulled upward. In this process, the pressing plate 43, the first and second springs 11 and 40, and the first and second lower caps 39 and 37 may be separated. The upper portion of the first spring 11 is fixed to the bottom of the pressing plate 43, and the lower portion of the first spring 11 is elastically inserted into the seating jaw 41 of the first lower cap 39. The upper portion of the second spring 40 is inserted into the protrusion jaw 45 of the first lower cap 39, and the lower portion of the second spring 40 is inserted into the jaw 36 of the second lower cap 37, thereby preventing separation.

That is, as the cosmetic liquid container 1 is used, the elastic force of the first and second springs 11 and 40 decreases. Thus, by rotating the screw groove 38 of the second lower cap 37 using a tool, the first and second springs 11 and 40 are raised to adjust and compensate the decreased elastic force.

Meanwhile, when the cosmetic liquid is filled into the cosmetic liquid container, the pressing plate 43 is raised due to the elasticity of the first and second springs 11 and 40 at the early stage, and thus, the upper space S of the pressing plate 43, that is, the space S for filling the cosmetic liquid, is not sufficiently secured.

Therefore, the filling pull rod 44 is initially mounted on the lower portion of the pressing plate 43, and the filling pull rod 44 is pulled down to fasten the nut B. The nut B is in contact with the bottom surface of the second lower cap 37, thereby fixing the filling pull rod 44.

As such, by fixing the filling pull rod 44 in a lowered state, the first and second springs 11 and 40 are contracted downward. Due to this, by pulling down the pressing plate 43 as well, the upper space S of the pressing plate 43, that is, the space in which the cosmetic liquid is filled, may be sufficiently expanded. Therefore, the cosmetic liquid filling operation may be easily performed.

After the cosmetic liquid is fully filled, the nut B is separated by cutting the lower end of the filling pull rod 44. Therefore, since the lower end of the filling pull rod 44 is in an unrestrained state, the pressing plate 43 is raised as the cosmetic liquid is used.

INDUSTRIAL APPLICABILITY

The present invention relates to a cosmetic liquid container, and more particularly, to a technology for improving a structure of a cosmetic liquid container so that a cosmetic liquid stored in a case is effectively pressed and discharged to the outside. Therefore, the present invention is applicable to the field of cosmetic industry.

The invention claimed is:

1. A cosmetic liquid container comprising:

a case (7) in which a cosmetic liquid is filled;

a pressing plate (43) disposed at an inner bottom of the case (7) and forming a cosmetic liquid filling space (S) in which the cosmetic liquid is filled in the upper portion, and pressing the cosmetic liquid upward;

elastic members (11, 40) disposed under the pressing plate (43) and pressing the pressing plate (43) toward the cosmetic liquid filling space (S);

a support part (13) coupled to the lower portion of the case (7), supporting lower portions of the elastic members (11, 40), and compensating elastic force by pressing the elastic members (11, 40) toward the pressing plate (43) upon rotation;

a filling pull rod (44) mounted on the lower portion of the pressing plate (43) and expanding the cosmetic liquid filling space (S) formed at an upper portion of the pressing plate (43) by pulling the pressing plate (43) downward to contract the elastic members (11, 40); and a pump (3) disposed to be movable upward or downward inside an upper cap (15) coupled to the upper portion of the case (7), and discharging the cosmetic liquid inside the case (7) when moving downward.

2. The cosmetic liquid container of claim 1, wherein the pump (3) includes:

a piston (21) that is mounted inside the upper cap (15) and a fixing cap (16), is movable upward or downward, and has a hollow formed therein so that the cosmetic liquid extruded from the case (7) is supplied;

an elastic body (23) that elastically presses the piston (21) upward; and a pusher (5) that is coupled to an upper portion of the piston (21) and has a hollow formed therein to communicate with the hollow of the piston (21) so that the cosmetic liquid is supplied, the piston (21) of the pump (3) includes:

a protrusion (25) formed at an upper portion and coupled to a groove (27) formed in a lower portion of the pusher (5); and a flange (29) formed in the middle and in contact with an upper portion of the elastic body (23), and the elastic body (23) is disposed in a space between the flange (29) and an upper surface of the case (7), the upper portion of the elastic body (23) is in contact with a bottom surface of the flange (29), and the lower portion of the elastic body (23) is in contact with a neck part (33) of the fixing cap (16) protruding from the upper portion of the case (7), so that the flange (29) is elastically supported upward.

3. The cosmetic liquid container of claim 1, wherein the elastic members (11, 40) include:

a first spring (11) provided under the pressing plate (43);

a first lower cap (39) supporting the first spring (11) from below; and a second spring (40) provided under the first lower cap (39) and elastically supporting the first lower cap (39) upward, and the first and second springs (11, 40) are compression springs.

4. The cosmetic liquid container of claim 3, wherein the support part (13) includes:

a support cap (35) screwed to the lower portion of the case (7);

a second lower cap (37) screwed to an inner side of the support cap (35); and a third lower cap (47) mounted between the inner side of the support cap (35) and an outer circumferential surface of the second lower cap (37), and elastic forces of the first spring (40) and the second spring (40) are adjusted by rotating the second lower cap (37).

5. The cosmetic liquid container of claim 4, wherein an upper portion of the first spring (11) is fixed to a bottom of the pressing plate (43), a lower portion of the first spring (11) is elastically inserted into a seating jaw (41) of the first lower cap (39), an upper portion of the second spring (40) is inserted into a protrusion jaw (45) of the first lower cap (39), and a lower portion of the second spring (40) is inserted into a jaw (36) of the second lower cap (37), whereby separation is prevented when the pressing plate (43) is pulled upward.

6. The cosmetic liquid container of claim 1, wherein an upper portion of the filling pull rod (44) is coupled to a lower surface of the pressing plate (43), a thread is formed at a lower portion of the filling pull rod (44), when the cosmetic liquid is filled, the nut (B) is fastened to the thread in a lowered state and the nut (B) is fixed by contacting a bottom surface of the second lower cap (37), and after the cosmetic liquid is fully filled, the pressing plate (43) is released from a fixed state by cutting the lower portion of the filling pull rod (44).

* * * * *